US005094254A

United States Patent [19]

Krueckel et al.

[11] Patent Number: 5,094,254

[45] Date of Patent: Mar. 10, 1992

[54] MASCARA APPLICATOR DEVICE

[75] Inventors: Peter Krueckel, Heroldsberg; Gerhard Moeck, Kirchehrenbach; Klaus D. Schroeder, Nuremberg, all of Fed. Rep. of Germany

[73] Assignee: Schwan Stabilo Schwanhausser GmbH & Co., Nuremberg, Fed. Rep. of Germany

[21] Appl. No.: 617,168

[22] Filed: Nov. 23, 1990

[30] Foreign Application Priority Data

Dec. 6, 1989 [DE] Fed. Rep. of Germany ... 8914353[U]

[51] Int. Cl.[5] ..... A45D 40/26

[52] U.S. Cl. ..... 132/218; 132/320; 401/199

[58] Field of Search ..... 132/216, 218, 320; 401/126, 127, 129, 130, 198, 199, 283

[56] References Cited

U.S. PATENT DOCUMENTS

| | | | |
|---|---|---|---|
| 2,099,030 | 11/1937 | Morrison | 132/320 |
| 2,140,009 | 12/1938 | Hand | 401/199 |
| 4,452,262 | 6/1984 | Jankewitz | 401/199 |
| 4,568,214 | 2/1986 | Abe et al. | 401/199 |
| 4,838,723 | 6/1989 | Suzuki et al. | 401/199 |
| 4,973,181 | 11/1990 | Jankewitz | 401/199 |

FOREIGN PATENT DOCUMENTS

| | | | |
|---|---|---|---|
| 883900 | 7/1943 | France | 132/218 |
| 1300952 | 7/1962 | France | 132/218 |
| 2445705 | 9/1980 | France | 401/199 |
| 41068 | 3/1983 | Japan | 401/198 |
| 50600 | 11/1985 | Japan | 401/199 |

*Primary Examiner*—John J. Wilson
*Assistant Examiner*—Frank A. LaViola
*Attorney, Agent, or Firm*—Bachman & LaPointe

[57] ABSTRACT

A device for applying liquid mascara comprises a reservoir for accommodating the mascara and an applicator having an applicator surface with a ribbed profile. At least the part of the applicator which forms the applicator surface comprises a material for conveying the liquid mascara by a capillary action. That material may be a directed fibre material or a porous sintered plastic material.

18 Claims, 1 Drawing Sheet

Fig. 1
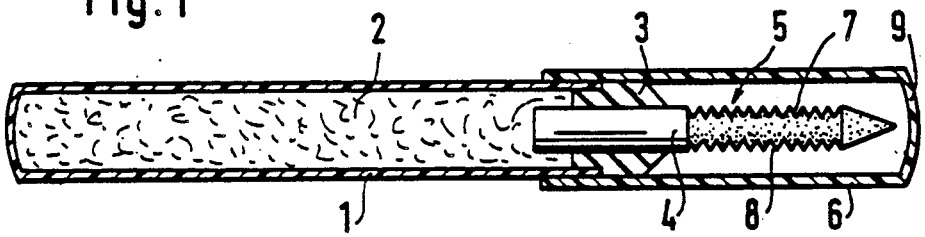
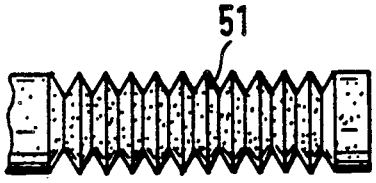
Fig. 2
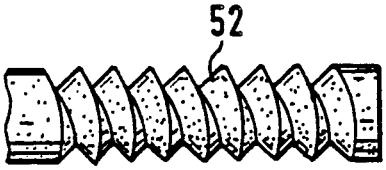
Fig. 3
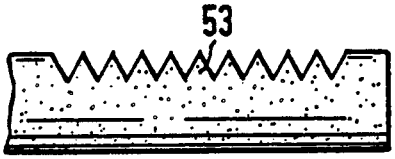
Fig. 4
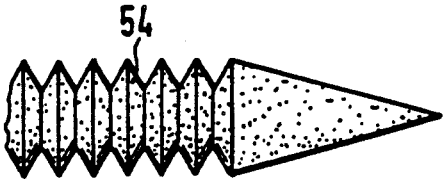
Fig. 5

MASCARA APPLICATOR DEVICE

BACKGROUND OF THE INVENTION

There are various forms of device for applying mascara which is capable of flow, for cosmetic purposes, often referred to as mascara pencils. Typically such a device may include a handle for using the device, and an applicator which can be of various configurations but which at any event is so designed as to provide a profiled applicator surface which can embrace the eyelashes to which mascara is to be applied, during the application process, so that the eyelashes are initially separated from each other, so-to-speak combed and also coloured with the mascara around their periphery, due to the embracing effect of the applicator profile. Thus for example the applicator may be in the form of a brush having bristles disposed in a helical arrangement. Applicators have also already been put forward in the form of an applicator cushion comprising porous flexible plastic foam (DE-A-34 34 405) or a relatively firm material with a ribbed profile (U.S. Pat. No. 3,363,635).

The previous mascara pencils are found to suffer from the disadvantage that, when picking up the mascara which is generally in the form of a paste or a liquid of high viscosity, by dipping the applicator into a supply of mascara, an excessively large amount of mascara is accumulated between the bristles of the brush-type applicator, on the applicator cushion or between the ribs of the ribbed profile respectively. The result of that is that excessive mascara is applied to the eyelashes at the beginning of the mascara application operation, and the application operation is thus irregular. It is therefore possible to achieve uniform distribution of the mascara on the eyelashes only by taking a great deal of trouble and care.

In an endeavour to deal with that disadvantage, mascara pencils have also been put forward, in which the mascara is accommodated in a reservoir forming part of the device, and is fed to the interior of the applicator member of the device by way of a communicating passage (as for example in DE-A-36 15 593). By applying pressure to the mascara in the reservoir, by means of a plunger which forms part of the device and which can be moved into the reservoir, a predetermined amount of mascara can be expelled from the applicator through openings therein which open to the applicator surface thereof, so that the profiled configuration of the applicator surface is wetted with the mascara. The stroke movement of the plunger for expelling the mascara is of such a magnitude or is adjustable so that only the amount of mascara actually required for the respective situation of use passes on to the applicator surface, thus avoiding excessive application of mascara and also ensuring that the device does not become smeared with mascara, in the course of time. However such mascara pencils are very complex and therefore relatively expensive as a result of the above-discussed design configuration involving an arrangement for supplying the mascara to the applicator surface in a metered flow.

The cosmetics field also already generally includes devices for applying make-up liquid, but not mascara pencils, in which the applicator has a tip comprising a material with a capillary conveying action as is to be found in DE-A-27 05 576, U.S. Pat. No. 3,399,020 and U.S. Pat. No. 3,605,764. The applicators of those devices are effective only to apply the make-up liquid substantially over an area and for that purpose have an applicator surface which tapers or even terminates in a point, as in the case of eyelid ink liners. Such applicators make use of the capability of the material for conveying liquid by a capillary action in the longitudinal direction of the applicator to the applicator surface or point. Mascara pencils involve a substantially different mode of operation insofar as they are not required to apply make-up liquid to the surface of the skin, possibly over a considerable area thereof.

SUMMARY OF THE INVENTION

An object of the present invention is to provide a device for applying mascara which, while being of a generally simple construction and therefore low in cost, can permit satisfactory feed and metering of the mascara to the applicator surface of the device.

Another object of the present invention is to provide a mascara applicator device which can provide a controlled feed of mascara to prevent excessive application and resulting smudging.

Still another object of the present invention is to provide a mascara applicator device which is simple to use while affording reliable and regular application of the mascara.

In accordance with the present invention the foregoing and other objects are achieved by a device for applying mascara which is capable of flow, comprising a reservoir for accommodating the mascara and an applicator means for applying same from the reservoir. The applicator means includes a part providing an applicator surface with a ribbed profile, in fluid communication with the reservoir. At least the part of the applicator means which provides the applicator surface comprises a material for conveying liquid by a capillary action.

By virtue of using a material for conveying liquid by capillary action, for at least the part of the device which forms the applicator surface, being in fluid communication with the reservoir and thus the liquid mascara disposed therein, it is possible to ensure that only that amount of mascara which is required to satisfy the need of the respective application operation is conveyed to the applicator surface by the capillary action. The feed of mascara to the applicator surface is thus self-regulating so that the device does not suffer from an excess supply of mascara, which results in the mascara being applied to the eyelashes in an excessively thick layer, with the disadvantages that result therefrom. The amount of mascara to be applied to the eyelashes can be determined by the number of application or stroking operations carried out on the eyelashes. As a result of the automatic regulating effect to provide the correct amount of mascara in any given situation of applying same to eyelashes, the device does not need any further structural features for conveying the respective properly metered amount of mascara to the applicator surface of the device. As a result the applicator can be constantly in communication with the liquid mascara in the reservoir without any fear of the liquid escaping therefrom or the device becoming smeared and smudged with mascara.

In a preferred feature of the invention the entire applicator means consists of the material for providing a capillary conveying action, and it has a connecting portion which extends into the reservoir to carry the mascara therefrom.

A preferred embodiment of the invention provides that the capillary action material is a fiber material in which the fibers extend parallel to each other, thus providing a very pronounced conveying effect for liquid in the longitudinal direction of the fibers, whereas the conveying effect is only slight transversely to the longitudinal direction of the fibers. It is known in relation to such a material that interruptions in the cross-section of a member reduce the capacity thereof for conveying liquid therethrough, and such interruptions must therefore be avoided as far as possible. That may be a reason why hitherto material with a capillary conveying action has only ever been put forward for use in cosmetic make-up applicators in which the applicator member has a closed applicator surface or point, but has never previously been used for mascara pencils in which the applicator surface is arranged at the periphery of an applicator member which is substantially in the form of a pencil element or of cylindrical configuration, and is interrupted by pronounced profiling such as accentuated ribs.

Now, the device in accordance with the invention is precisely such as to make use of the conveying effect transversely with respect to the longitudinal direction of the applicator, such conveying effect being reduced by virtue of the interruptions in the applicator surface in the form of a ribbed profile such as annular ribs, in order thereby to provide that the cavities of the ribbed profile are not excessively filled with mascara, so as to maintain the above-mentioned self-regulating effect.

The material with capillary conveying action may be a directed fiber material or a porous sintered plastic material. In order to provide for a satisfactory capillary conveying action, the cosmetic mascara must be sufficiently capable of flow or fluid. The mascara may comprise for example pigment dispersions with pigments in very fine grain form, as are already known in relation to eyelid ink liners. Those dispersions can be conveyed through the capillary action material in the above-depicted manner.

The intensity of the mascara conveying action may be determined by the nature and selection of the capillary action materials in fiber form or in sintered form. If the mascara is accommodated in the reservoir of the device in a free-flow mode, a lower degree of capillarity of the material may be appropriate. As an alternative to that however and in accordance with another preferred feature of the invention the mascara may be accommodated in a wick-like storage element acting as the reservoir. In that case the capillarity or capillary suction effect of the applicator must exceed the capillary retaining effect of the storage element, and will therefore generally be comparatively pronounced.

The material with capillary conveying action which is used in accordance with the invention for the applicator of the mascara applicator device makes it possible to use any suitable profile configurations for application purposes. Thus, the profile configuration of the applicator of the device according to the invention, in the form of a mascara pencil, may preferably be in the form of annular ribs of sawtooth-like configuration, which extend around the rest of the cylindrical circumference of the applicator. The ribbed profile of the applicator may also be a rib extending in a helical fashion, of sawtooth-like configuration in axial section. The ribbed profile may alternatively comprise ribs of sawtooth shape provided only at one longitudinal side of the applicator. The ribs may also be interrupted as required.

The ribbed profile of the applicator can be produced for example by grinding with a grinding wheel of suitable profile. When using sintered plastic material, it is also possible to envisage the ribbed profile being produced at the time of the applicator sintering or shaping process.

Instead of being of a substantially cylindrical configuration, the applicator may also be tapered, with a conical configuration or with a curvature in an outward direction. An applicator which terminates in a point at its free end, particularly when it also tapers over its entire length and has a slightly barrel-like curvature in an outward direction, may be used to particular advantage both as a mascara pencil and as an ink liner, thus combining two functions in one device.

Further objects, features and advantages of the invention will be apparent from the following description of preferred embodiments thereof.

BRIEF DESCRIPTION OF THE DRAWING

FIG. 1 is a view in axial section of an applicator device according to the invention, and FIGS. 2 through 5 show possible embodiments of the shape and profiling of the applicator member.

DESCRIPTION OF PREFERRED EMBODIMENTS

Referring firstly to FIG. 1, a device for applying mascara which is capable of flow, in accordance with the invention, comprises a tubular body or stem portion 1 of plastic material which in its interior forms a reservoir 2 for accommodating cosmetic mascara. At its front end, towards the right in FIG. 1, the body portion 1 is closed by a sealing member 3 through which a connecting portion 4 of an applicator member which is generally identified by reference numeral 5 is passed and sealingly held therein. The reservoir 2 may comprise a wick-like fleece or fiber material which accommodates the mascara in capillary-bound form.

Fitted on to the front end of the body portion 1 is a plastic cap 6 for covering over the applicator member 5.

The applicator member 5 is composed of the above-mentioned connecting portion 4 and a part 7 which forms an applicator surface with a ribbed profile as indicated at 8. In the illustrated embodiment, the part 7 tapers down to a tip in its end portion as indicated at 9. In the illustrated embodiment the applicator member 5 entirely comprised fiber material with a capillary conveying action, or a porous sintered plastic material, for example polyethylene or polypropylene. Such a material is made for example from polypropylene powder with an average particle size of from 25 to 50μ, preferably from 30 to 40μ, by a process in which the polypropylene powder is pressed at a temperature of about 150° to 160° C. just beneath the melting range of the polypropylene, and thereby sintered. That procedure results in pores or passages with a capillary action, of a width of the order of magnitude of from 10 to 60μ.

By virtue of the applicator 5 being formed from the above-discussed material with a capillary conveying action, the illustrated communication between the applicator member 5 and the reservoir 2 provides that mascara is sucked out of the reservoir 2 due to the capillary action and conveyed to the applicator surface of the part 7 of the applicator member. When the applicator member is saturated with the mascara, no further feed of the mascara from the reservoir 2 takes place and the applicator member does not suffer from dripping of mascara therefrom or smudging or smearing of mascara over the applicator member or the body of the applicator device. If, in use of the device which is shown here by way of example as being in the form of a mascara pencil, mascara is applied to the eyelashes from the applicator surface of the applicator member 5, the capillary action at the surface of the applicator member, which comes into effect when mascara is removed from the applicator surface by being applied to eyelashes, causes a further amount of mascara to be drawn from the reservoir and fed to the applicator surface of the applicator member, to replace the amount of mascara removed from the applicator surface by application thereof.

In place of the configuration of the applicator member 5 shown in FIG. 1, it is possible to use the shapes and profile configurations shown in FIGS. 2 through 5. Those shapes and profile configurations are suitable for use as a mascara pencil, while the embodiments shown in FIGS. 1 and 5 can also be used as an ink liner.**

Moreover, all of the applicators disclosed may be used also as eyebrow-pencil Referring therefore to FIG. 2, the applicator member is shown as being substantially cylindrical, and bears a number of annular ribs 51** which are of a sawtooth-like configuration in axial section and which extend in a closed configuration around the periphery of the applicator member.

In FIG. 3, the applicator member is again substantially cylindrical and includes an annular rib 52 of sawtooth-like profile, extending in a helical configuration on the applicator member.

In FIG. 4 sawtooth-shaped ribs 53 are provided only at one longitudinal side of the applicator member.

In FIG. 5 the applicator member is of a form which is slightly curved in a barrel-like configuration and tapers to a point. In its rearward portion, towards the left in FIG. 5, the applicator member has a plurality of annular ribs 54 of the same general configuration as those shown in FIG. 2, although the diameter of the ribs 54 in FIG. 5 decreases towards the tip at the right-hand side in FIG. 5, corresponding to the generally tapering configuration of the applicator member.

It will be found that a device for applying mascara, as described above, makes it possible to keep down the cost of production and thus the price of the device, while nonetheless permitting a satisfactorily metered feed of mascara.

It will be appreciated that the foregoing constructions have been set forth solely by way of example and illustration of the principles of the invention and that various other modifications and alterations may be made therein, for example in regard to further modifications to the configuration of the applicator member indicated generally at 5 in FIG. 1, without thereby departing from the spirit and scope of the invention.

What is claimed is:

1. A device for applying liquid mascara which is capable of flow comprising: a reservoir for accommodating liquid mascara; and an applicator means having a longitudinal axis, said applicator means being in fluid communication with the reservoir and includes an applicator surface comprising a profile having ribs substantially extending traversely with respect to the longitudinal axis of the applicator means wherein at least the part of the applicator means which forms the applicator surface is formed of a directed fiber material wherein individual fibers extend parallel to each other so as to produce an uninterrupted conveying effect for liquid substantially along the longitudinal direction of the individual fibers for conveying liquid by capillary action.

2. A device as set forth in claim 1 wherein the applicator means consists of said capillary action conveying material and includes a connecting portion extending into the reservoir.

3. A device as set forth in claim 1 wherein the reservoir is a wick-like storage element, the capillarity of which is lower than that of the said material of said applicator means.

4. A device as set forth in claim 1 wherein the applicator surface of said applicator means tapers towards the free end thereof.

5. A device as set forth in claim 4 wherein said applicator surface is curved outwardly.

6. A device as set forth in claim 1 wherein said applicator surface of said applicator means forms a point at the free end thereof.

7. A device as set forth in claim 1 wherein the ribbed profile of the applicator surface is formed by annular ribs of sawtooth configuration in axial section.

8. A device as set forth in claim 1 wherein the ribbed profile of the applicator surface is formed by ribs of sawtooth shape provided only at one longitudinal side of the applicator means.

9. A device as set forth in claim 1 wherein the profiling of the applicator surface is formed by a rib extending in a spiral configuration.

10. A device for applying liquid mascara which is capable of flow comprising: a reservoir for accommodating liquid mascara; and an applicator means having a longitudinal axis, said applicator means being in fluid communication with the reservoir and includes an applicator surface comprising a profile having ribs substantially extending traversely with respect to the longitudinal axis of the applicator means wherein at least the part of the applicator means which forms the applicator surface is formed of a porous sintered plastic material having a pore width of between about 10 to 60 microns for conveying liquid by capillary action.

11. A device as set forth in claim 10 wherein the applicator means consists of said capillary action conveying material and includes a connecting portion extending into the reservoir.

12. A device as set forth in claim 10 wherein the reservoir is a wick-like storage element, the capillarity of which is lower than that of the said material of said applicator means.

13. A device as set forth in claim 10 wherein the applicator surface of said applicator means tapers towards the free end thereof.

14. A device as set forth in claim 10 wherein said applicator surface is curved outwardly.

15. A device as set forth in claim 10 wherein said applicator surface of said applicator means forms a point at the free end thereof.

16. A device as set forth in claim 10 wherein the ribbed profile of the applicator surface is formed by annular ribs of sawtooth configuration in axial section.

17. A device as set forth in claim 10 wherein the ribbed profile of the applicator surface is formed by ribs of sawtooth shape provided only at one longitudinal side of the applicator means.

18. A device as set forth in claim 10 wherein the profiling of the applicator surface is formed by a rib extending in a spiral configuration.

* * * * *